United States Patent [19]

Dively et al.

[11] 4,042,047

[45] Aug. 16, 1977

[54] RAISE BORING HEAD HAVING FLUID TRAVERSING MEANS

[75] Inventors: Charles R. Dively; Russell K. Peterson, both of Seattle, Wash.

[73] Assignee: Ingersoll-Rand Company, Woodcliff Lake, N.J.

[21] Appl. No.: 740,839

[22] Filed: Nov. 11, 1976

Related U.S. Application Data

[63] Continuation of Ser. No. 619,655, Oct. 6, 1975, abandoned.

[51] Int. Cl.[2] ..... E21B 9/08

[52] U.S. Cl. ..... 175/340; 175/53; 175/422; 175/344

[58] Field of Search ..... 175/53, 212, 231, 339, 175/340, 393, 406, 422; 166/222, 223, 298; 299/81

[56] References Cited

U.S. PATENT DOCUMENTS

| | | | |
|---|---|---|---|
| 1,831,209 | 11/1931 | Thornley et al. | 175/422 X |
| 1,922,436 | 8/1933 | Herrington | 175/340 X |
| 2,090,356 | 8/1937 | Reed | 175/340 |
| 2,218,130 | 10/1940 | Court | 175/422 X |
| 2,307,658 | 1/1943 | Appleby | 175/422 X |
| 2,327,051 | 8/1943 | Lyons et al. | 166/222 X |
| 2,688,463 | 9/1954 | Bettes | 175/340 X |
| 3,116,800 | 1/1964 | Kammerer | 166/222 X |
| 3,231,031 | 1/1966 | Cleary | 175/422 X |
| 3,331,456 | 7/1967 | Pittman | 175/422 |
| 3,486,572 | 12/1969 | Hamilton et al. | 175/53 |
| 3,638,740 | 2/1972 | Justman | 175/344 X |
| 3,785,875 | 3/1957 | Hayes | 175/422 X |
| 3,876,253 | 4/1975 | Parker | 175/393 X |
| 3,905,430 | 9/1975 | Poundstone | 175/53 |

FOREIGN PATENT DOCUMENTS

| | | | |
|---|---|---|---|
| 52,959 | 3/1967 | Poland | 175/422 |

*Primary Examiner*—Ernest R. Purser
*Assistant Examiner*—Richard E. Favreau
*Attorney, Agent, or Firm*—Bernard J. Murphy

[57] ABSTRACT

The raise boring head comprises a stem in which is formed a passageway which extends fully throughout the axial length thereof for conducting fluid therethrough. The uppermost end of the passageway defines an inlet and, at the lowermost end, the same comprising an outlet, a coupling is fixed to receive threaded fitting elements for use to control and/or direct fluid flow from the outlet or axial end of the passageway. By this means a spray nozzle, as disclosed in one embodiment, can be threaded into the coupling to direct a conical spray of water onto the walls of the bore in order to suppress dust. In alternative embodiments, hose or like conduits can be used in operation with the passageway to facilitate the use of hydraulic, electrical, or pneumatic tools and devices in a subterranean chamber or tunnel below the raise.

5 Claims, 3 Drawing Figures

RAISE BORING HEAD HAVING FLUID TRAVERSING MEANS

This is a continuation, of application Ser. No. 619,655 filed Oct. 6, 1975, now abandoned.

This invention pertains to raise borers, and in particular to a raise boring head having fluid traversing means for conducting fluid in penetration of the raise boring head between upper and lower levels, in order that such fluid might be put to use for dust suppression, powering tools and devices, and the like.

In this art it is customary to design raise boring heads with a central driving stem which has a borehole, commonly of three-inch diameter, or the like, running the full axial length thereof. Ordinarily the borehole is either not employed or, alternatively, may be used as a lubricant passageway to introduce grease or the like to cutters mounted on a cutterhead to which the stem is coupled. Such an arrangement is disclosed in U.S. Pat. No. 3,675,729, issued on July 11, 1972, to William J. Neilson, for a "Bit Lubrication System".

In raise boring operations commonly there are occasions when it is desired to open a passageway fully through the raise boring head, just at the time when the raise boring head obstructs such communication, in order that compressed air, hydraulic oil, water, or electricity might be passed through to facilitate below-level operations attending the raise boring process.

Particularly it would be desirable to employ the axially-formed passageway in the stem to receive an adapter to which some manner of water dispersal device can be filled to cause a cone of water to be directed onto the walls of the bore to prevent dust contamination therebelow. Also, it would be useful to employ the central borehole to receive hydraulic fluid or compressed air, and conduits or lines therefor, so that tools powered by such fluids can be employed beneath the raise for ancillary earth breaking, or clean up, and also for performing repairs or servicing of the cutterhead.

It is therefore an object of this invention to provide a raise boring head having fluid traversing means which will accommodate the conduction of working, pressured fluid or electricity through the raise borer. It is also an object of this invention to set forth a raise boring head having fluid traversing means, comprising a passageway, traversing said raise boring head, formed in said raise boring head for conducting fluid therethrough; said passageway having an inlet and an outlet; and means replaceably interposed in said outlet for controllingly directing fluid flow from said outlet.

Further objects of this invention, as well as the novel features thereof, will become more apparent by reference to the following description taken in conjunction with the accompanying Figures in which:

FIG. 3 is a discontinuous illustration of a stem having the fluid traversing passageway formed therein in which a line for electricity, water, oil, or compressed air is freely and slidably disposed.

Figure 1:
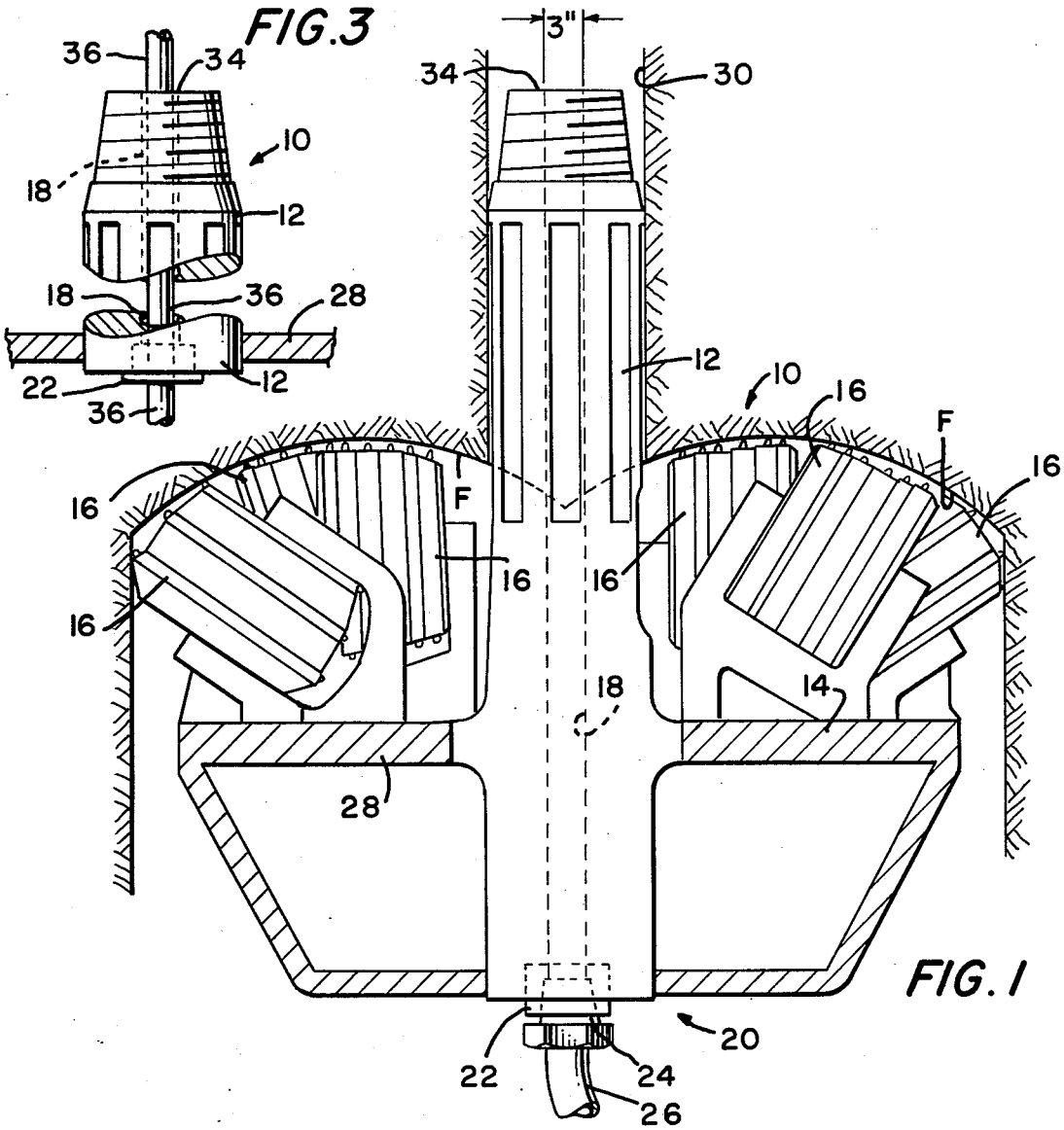
FIG. 1 is an axial, cross-sectional view in elevation of a typical raise boring head which has been modified in accordance with the invention.

In the Figures, a raise boring head 10 is depicted which has a vertical stem 12 coupled to a cutterhead 14 on which are mounted a plurality of rotary cutters 16, in accordance with practices well known in this art. The stem 12, according to the invention, has a passageway 18 extending fullytherethrough which, in this embodiment, is three inches in diameter. At the lowermost or outlet end 20 of the passageway there is fixed a coupling 22, the coupling being internally threaded to receive a threaded fitting or adapter 24 for a pneumatic, hydraulic oil, or water line 26.

The cutters 16, according to the known practice, rotate and abrade the earth face F upon the stem 12 being rotated and causing the cutterhead platform 28 to rotate therewith. The stem is constantly forced upward through a pre-drilled pilot hole 30 in order that the cutters will enlarge the bore. In this practice, the raise boring head 10 commences the enlargement of the pilot-holed bore by proceeding from a lower level to an upper level (or to the earth surface) and, during the cutting, earth fragments and dust fall downward near to where other operations are being pursued. It is adequate and safe enough for operators therebelow to remove themselves from the falling cuttings' area. However, the dust fills and descends the bore, and insinuates itself into all adjacent working areas below. For this reason it is a teaching of this invention to thread a conical-type nozzle 32 into a coupling adapter 24', and to supply water under pressure through the inlet end 34 of the passageway. A wide, conical spray S of water issues from the nozzle 32 to wet down the wall of the bore, and to intercept and saturate any dust descending from the cuttings.

Alternatively, of course, it will be sufficient simply to pass an air hose or hydraulic or electrical line 36 (FIG. 3) slidably and freely through the central passageway 18. In this way, the hose or line 36 can simply be withdrawn, from either the top or the bottom of the raise boring head 10, when it is no longer required.

In the prior art, there is known U.S. Pat. No. 3,841,421, issued on Oct. 15, 1974, for an "Apparatus for Boring a Pit", to K. Matsushita, in which there is disclosed an apparatus of the type named. The apparatus has a central drive shaft with a passageway formed fully therethrough and which terminates in a nozzle. The nozzle is cooperative with a manifold or water passage which also opens onto further nozzles disposed directly outward from the working end of the apparatus. The limitations in such apparatus, on which the instant invention improves, is that the nozzles are exposed to abrading damage, as they share a surface in common with earth cutters, and the central shaft and the main cutterhead require integral or unitized forming. In the instant disclosure, the one central stem alone requires the passageway, and may be separable from the cutterhead. Too, the stem has a threaded coupling which will receive, alternatively, adapters for a spray nozzle for dust suppression, or for air, hydraulic oil, or water. So also, in the instant disclosure, the passageway is sufficiently large to accommodate a free, sliding penetration of the passageway 18 by hose, line, cable and the like, and a free unobstructed removal thereof from the passageway.

Figure 2:
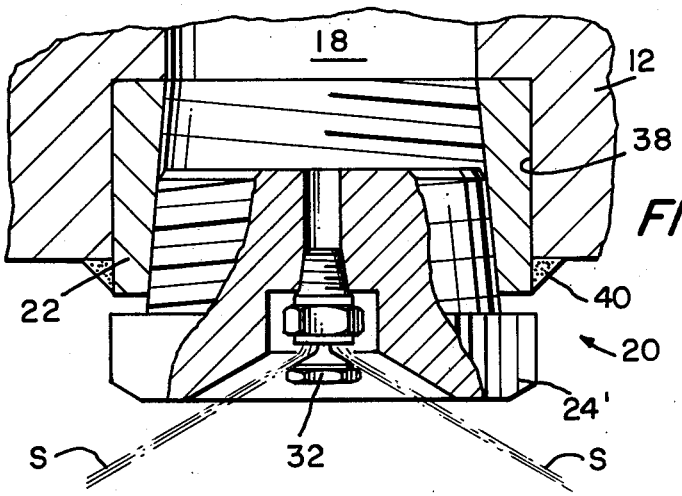
FIG. 2 is an enlarged detail, also in cross-section, showing the deployment of a coupling and a spray nozzle in the lowermost or outlet end of the passageway.

Stem 12 has a straight-sided counter-bore 38 formed in the outlet end 20 to receive the coupling 22. Now then, to secure the coupling 22 in place, and to effect a liquid and air seal thereat, an annular bead of weld 40 is deposited about an extending portion of the coupling. The weld 40 defines a sort of fillet which can be cut away when it is necessary to replace a damaged coupling 22. Coupling damage will occur rarely, however, as the item is below the cutterhead 14 and is largely protected from exposure to falling rock fragments. Too, as FIG. 2 illustrates, coupling adapter 24' receives the nozzle 32 recessively therewithin. Accordingly, when the adapter 24' and nozzle 32 are employed, the adapter 24' shieldably envelops the nozzle 32 thereabout also to protect the nozzle from exposure to falling rock fragments.

While we have described our invention in connection with specific embodiments thereof, it is to be clearly understood that this is done only by way of example and not as a limitation to the scope of the invention as set forth in the objects thereof and in the appended claims.

We claim:

1. A raise boring head having cuttings dust suppression means, comprising:

a passageway, formed in and traversing said raise boring head, for conducting a liquid, such as water, therethrough;

said raise boring head comprising a platform having a first, uppermost surface for mounting earth cutters thereto;

said platform also having a second, lowermost surface; wherein said passageway has an outlet opening substantially centrally of said second surface; and including means fixed in said outlet for discharging liquid therethrough in a conical-form spray pattern, to cause outlet-discharged liquid to form a dust-intercepting curtain and to impinge on, and wet down, raise bore walls.

2. A raise boring head, according to claim 1, wherein:

said raise boring head further comprises a stem having an elongate axis; wherein said stem is coupled to said platform for moving said first surface towards, and away from, an earth surface;

said passageway is axially formed in said stem; and said outlet is formed in a lowermost end of said stem.

3. A raise boring head, according to claim 1, wherein:

said liquid-discharging means comprises a nozzle;

said nozzle being replaceably fixed in said outlet.

4. A raise boring head, according to claim 3, wherein:

said outlet has a threaded adapter fixed therein; and said nozzle is replaceably threaded into said adapter.

5. A raise boring head, according to claim 4, wherein;

said nozzle is recessed within and is wholly and shieldably enveloped thereabout by said adapter means, and is replaceable from said raise boring head independently of said adapter means.

* * * * *